US005350243A

United States Patent [19]

Ichinomiya et al.

[11] Patent Number: 5,350,243

[45] Date of Patent: Sep. 27, 1994

[54] TAPE CASSETTE

[75] Inventors: Yoshio Ichinomiya, Aichi; Koshiro Yamaguchi, Kasugai; Nobuo Kato, Nagoya, all of Japan

[73] Assignee: Brother Kogyo Kabushiki Kaisha, Aichi, Japan

[21] Appl. No.: 1,099

[22] Filed: Jan. 6, 1993

[30] Foreign Application Priority Data

Jan. 8, 1992 [JP] Japan ..... 4-020581
Jul. 3, 1992 [JP] Japan ..... 4-176957

[51] Int. Cl.[5] ..... B41J 35/28

[52] U.S. Cl. ..... 400/208; 242/594; 242/615

[58] Field of Search ..... 400/621, 208, 196, 207, 400/208.1; 242/197, 198, 199, 192; 101/288; 156/384, 387

[56] References Cited

U.S. PATENT DOCUMENTS

| | | | |
|---|---|---|---|
| 3,075,627 | 1/1963 | Kuckhoff | 400/208 |
| 4,006,493 | 2/1977 | Gerry | 242/192 |
| 4,815,874 | 3/1989 | Richardson et al. | 400/208 |
| 4,830,522 | 5/1989 | Sato et al. | 400/621 |
| 4,944,619 | 7/1990 | Suzuki et al. | 400/208 |
| 5,022,771 | 6/1991 | Paque | 400/208 |
| 5,049,228 | 9/1991 | Sato | 400/208 |
| 5,066.152 | 11/1991 | Kuzuya et al. | 400/621 |
| 5,115,322 | 5/1992 | Jang | 400/621 |
| 5,174,670 | 12/1992 | Takagi et al. | 400/621 |
| 5,188,469 | 2/1993 | Nagao et al. | 400/621 |
| 5,209,151 | 5/1993 | Takagi et al. | 400/621 |

FOREIGN PATENT DOCUMENTS

| | | | |
|---|---|---|---|
| 0364305 | 4/1990 | European Pat. Off. | 400/621 |
| 0019573 | 1/1985 | Japan | 400/621 |
| 0032868 | 2/1991 | Japan | 400/621 |

OTHER PUBLICATIONS

"Paper Guillotine, Platen Guide & Feed Mechanism" IBM Tech. Discl. Bulletin, vol. 26, No. 7A, Dec. 1983, pp. 3333–3334.

"Perforated Forms Tear Clip" IBM Technical Disclosure Bulletin, vol. 29, No. 4, Dec. 1986, pp. 15–93.

*Primary Examiner*—Eugene H. Eickholt

*Attorney, Agent, or Firm*—Kane, Dalsimer, Sullivan, Kurucz, Levy, Eisele and Richard

[57] ABSTRACT

A tape cassette accommodating a tape-shaped member has an accommodation case and a cover for covering the accommodation case. On the accommodation case, an exit slit is formed, the tape-shaped member being fed out of the tape cassette through the exit slit. On the accommodation case, a protruded portion is formed at the exit slit, the protruded portion is protruded by a predetermined amount in the feeding direction of the tape-shaped member and extending along the exit slit. Further, a pair of snapping members are provided on one of the cover member and the accommodation case, while receiving member Is provided on the other for receiving the snapping members so as to fix the cover member onto the accommodation case.

19 Claims, 10 Drawing Sheets

TAPE CASSETTE

BACKGROUND OF THE INVENTION

The present invention relates to a tape cassette used for a printing device which is capable of printing images such as alphanumeric characters onto a tape shaped recording medium.

Conventionally, there is proposed a printing device for creating a tape by printing reversed images of characters and the like on the backside of a transparent tape, and by adhering the transparent tape to a double-sided adhesive tape having a release paper on one side thereof. The created tape is adhered to a video cassette and the like as an index and the like.

A tape cassette is exchangeably mounted to this kind of printing device. In the printing device, there is provided a cutter. The tape created as explained above is ejected from the tape cassette, and then cut by the cutter provided in the printing device.

Nevertheless, after the tape has been cut, the extreme end of the tape is projected with respect to the tape cassette because the tape has been cut outside the cassette. If the tape cassette is detached from the printing device with the extreme end of the tape being projected a finger may be touched with the extreme end of the tape and the tape at the exit portion may be pushed inside the cassette case. Alternatively, the extreme end of the tape may be retracted inside the cassette case due to the back tension of the film tape.

The amount of the tape projected from the cassette case is relatively large with respect to the thickness of the cassette case. Thus, when the extreme end of the tape is retracted into the inside of the cassette case. It is not easy to pull out the extreme end of the tape retracted into the cassette case and it would be a laborious and time-consuming job to draw the end of the tape out of the tape cassette. Further, when the tape cassette is coupled to the printing device with the extreme end of the tape being retracted into the tape cassette and the tape is created. a problem arises in that the tape is hitched in the tape cassette and cannot be fed out.

Further, in general, the tape cassette comprises a lower case member **16*b* and an upper cover member 16*a* as shown in FIG. 15. Pins 29 are provided on the under surface of the upper cover member 16*a*. The pins 29 are inserted into holes 31 formed on the side wall of the lower case member 16*b*. A tape member 26 is, in this example, wound around a spool 28, which is rotatably fitted on a shaft 27 projected from the lower case member 16*b***.

With this construction, if the tape 26, or, if the tape 26 is an adhesive tape provided with a release paper the release paper is deformed, or expanded due to the environmental heat or humidity, the internal stress of the wounded tape member 26 is changed, thereby the winding state of the tape member being dislocated toward an axial direction and deformed to a conical state. In such a case, as shown in FIG. 16, the outer circumference of the tape member 26 presses upwardly the portion of the upper cover member **16*a* which is apart from the outer circumference of the upper cover member 16*a*. Thus the tape cassette 16** Is deformed.

When the tape cassette 16 is deformed by the deformation of the tape member 26, the upper cover member **16*a* is strongly abutted against the upper portion of the tape member 26 by the force of the upper cover member 16*a* attempting to return to it's original state. When the tape member 26 is pulled out of the tape cassette 16, the wounded tape member 26 is rotated together with the adhesive tape spool 28. Accordingly, if the upper cover member 16*a* is strongly abutted against the upper portion of the wounded tape member 26, a large resistance is applied to the tape member 26. Thus, a problem arises in that the tape member 26** is difficult to be pulled out because the rotation of the tape spool becomes heavy.

Further, there is also a problem that when the tape cassette 16 is deformed, a cover of the printing device cannot be closed when the tape cassette 16 is attached to the printing device.

SUMMARY OF THE INVENTION

It is therefore an object of the present invention to provide a tape cassette in which the extreme end of a tape member accommodated therein is prevented from retracting inside a cassette case.

Another object of the present invention is to provide a tape cassette which is difficult to be deformed.

For the above objects, according to an aspect of the invention, there is provided a tape cassette accommodating a tape-shaped member, said tape cassette comprising an accommodation case member and a cover member for covering said accommodation case, an exit slit being formed on said accommodation case member, wherein said tape-shaped member being fed out of said tape cassette through said exit slit, and wherein said accommodation case member has at least one protruded portion at said exit slit, said protruded portion being protruded by a predetermined amount in the feeding direction of said tape-shaped member and extending along said exit slit.

Optionally, said protruded portion is formed to protrude on the outer side of said accommodation case.

Further optionally, said tape cassette accommodating a plurality of tape-shaped members, said plurality of tape-shaped member being drawn out of said tape cassette through said exit slit.

According to another aspect of the Invention, there is provided a combination of a printing device and a tape cassette accommodating an tape-shaped member to be used for printing by said printing device, wherein said tape cassette comprises an accommodation case member and a cover member for covering said accommodation case, an exit slit being formed on said accommodation case member, said tape-shaped member being fed out of said tape cassette through said exit slit, wherein said accommodation case member has at least one protruded portion at said exit slit, said protruded portion being protruded by a predetermined amount in the feeding direction of said tape-shaped member and extending along said exit slit, and wherein said printing device comprises cutter means for cutting said tape-shaped member in the vicinity of said exit slit.

According to further aspect of the invention, there is provided a tape cassette, comprising an accommodation case member for accommodating a tape-shaped member, and a cover member for covering said accommodation case member, said tape cassette further comprising:

snapping means provided on one of said cover member and said accommodation case member; and receiving means provided on the other one of said cover member and said accommodation member for receiving said at least one snapping members so as to fix said cover member onto said accommodation case member.

According to still further aspect of the invention, there is provided a tape cassette accommodating a tape-shaped member which is wound around a spool, said tape cassette comprising an accommodation case member provided with a shaft, said spool being rotatably fitted on said shaft, and a cover member for covering said accommodation case member, said tape cassette further comprising:

engaging means provided on one of the extreme end of said shaft and said cover member; and receiving means provided on the other of said extreme end and said cover member for receiving said engaging means to fix said cover member onto said accommodation case member.

DESCRIPTION OF THE ACCOMPANYING DRAWINGS

Figure 11A:
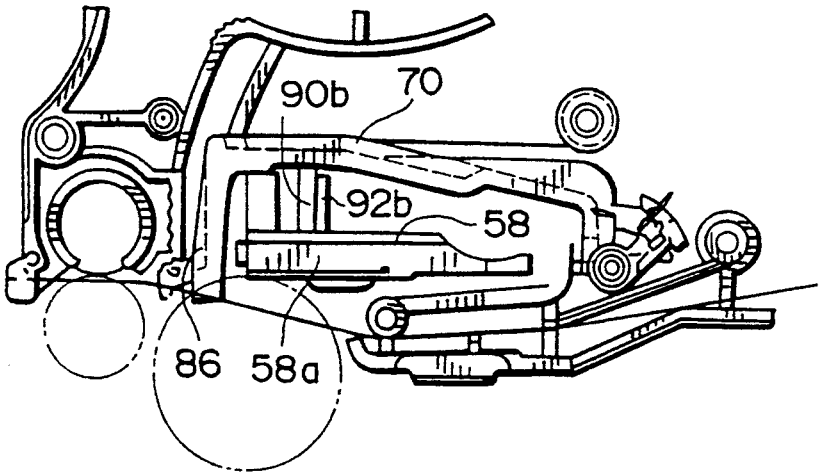
Figure 12A:
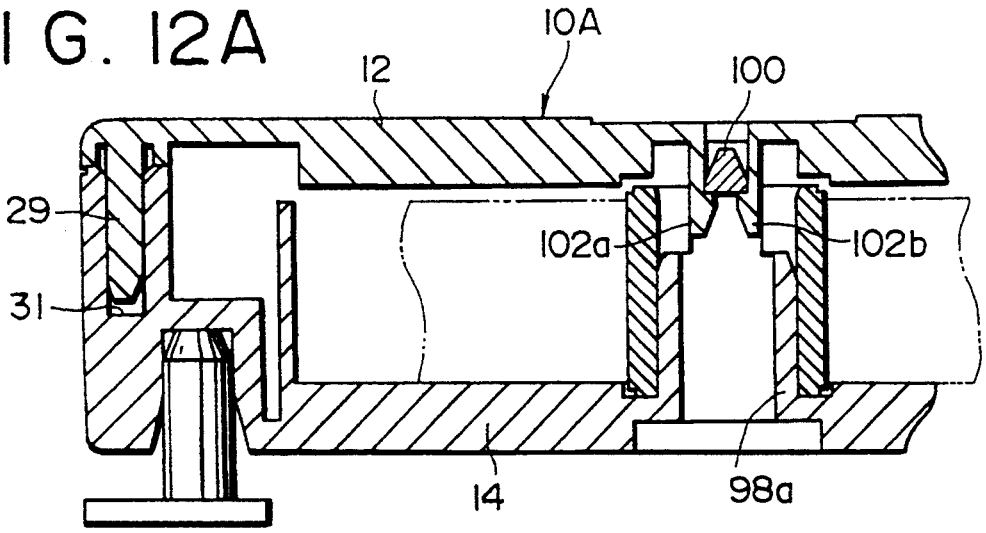
Figure 12B:
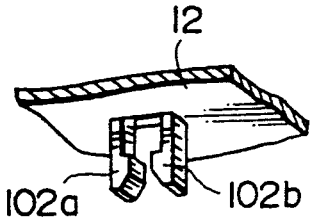
Figure 12C:
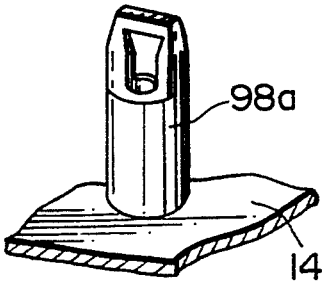
Figure 13:
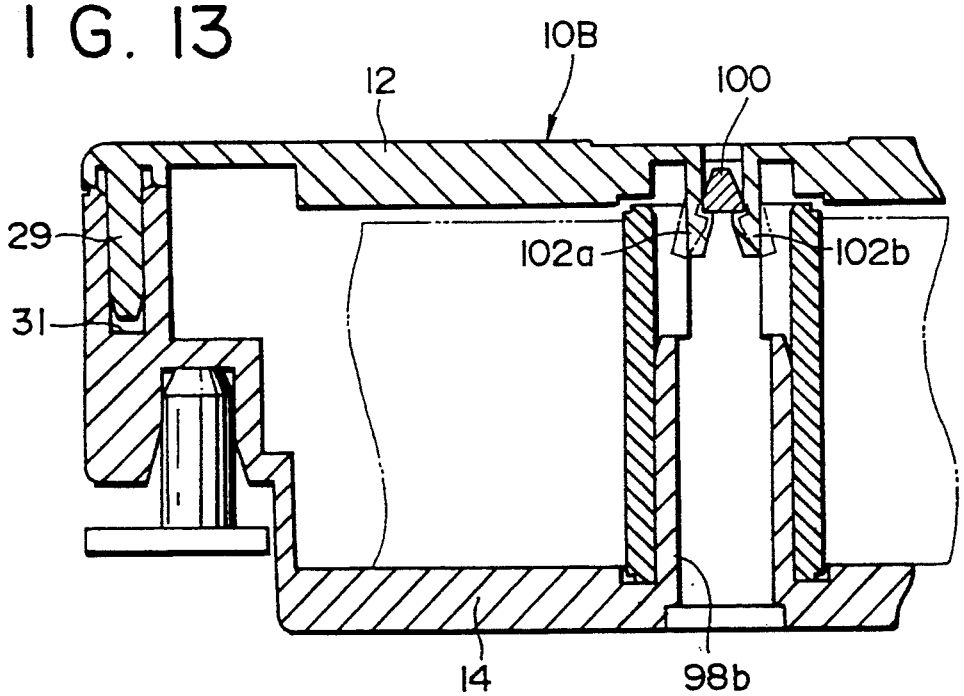
Figure 14:
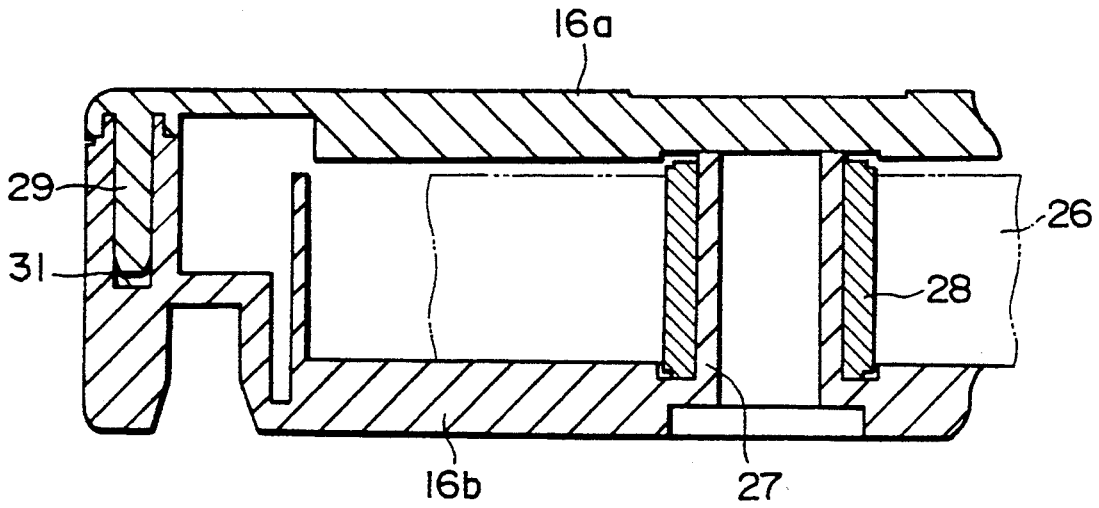
Figure 15:
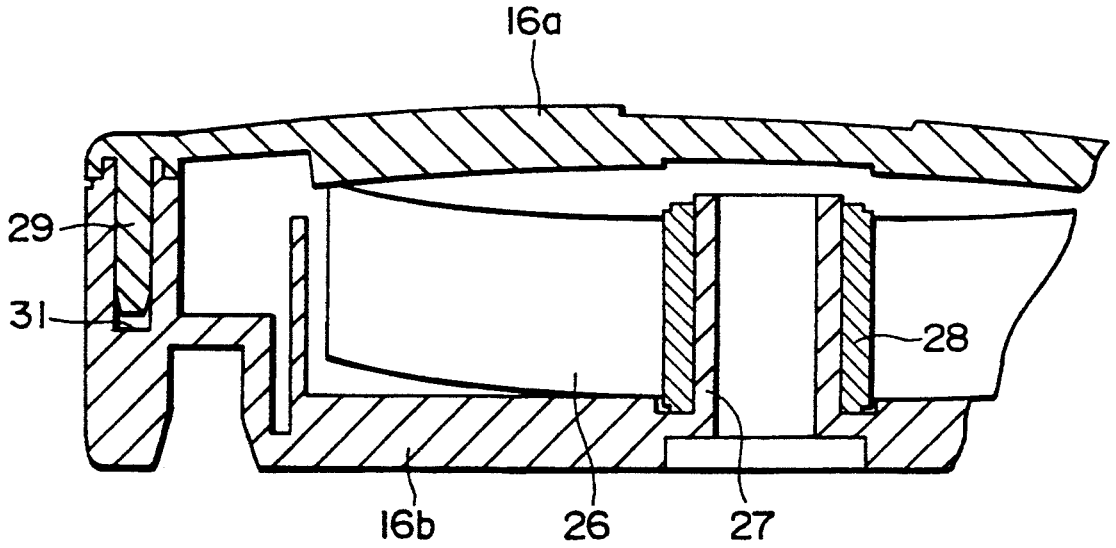

FIGS. 11A and lib are diagrams explaining the rotating state of the tension lever when the wide tape cassette is mounted to the printing device;

FIG. 12A is a cross sectional view explaining the engaging state of the upper cover member and lower case member of the narrow tape cassette;

FIGS. 12B and 12C show a snapping members and a receiving member;

FIG. 13 is a cross sectional view explaining the engaging state of the upper cover member and lower case member of the wide tape cassette;

FIG. 14 is a cross sectional view explaining the engagement state of the upper cover member and lower case member of the conventional tape cassette; and FIG. 15 is a cross sectional view of the deformed state of the conventional tape cassette.

DESCRIPTION OF THE EMBODIMENTS

Figure 1A:
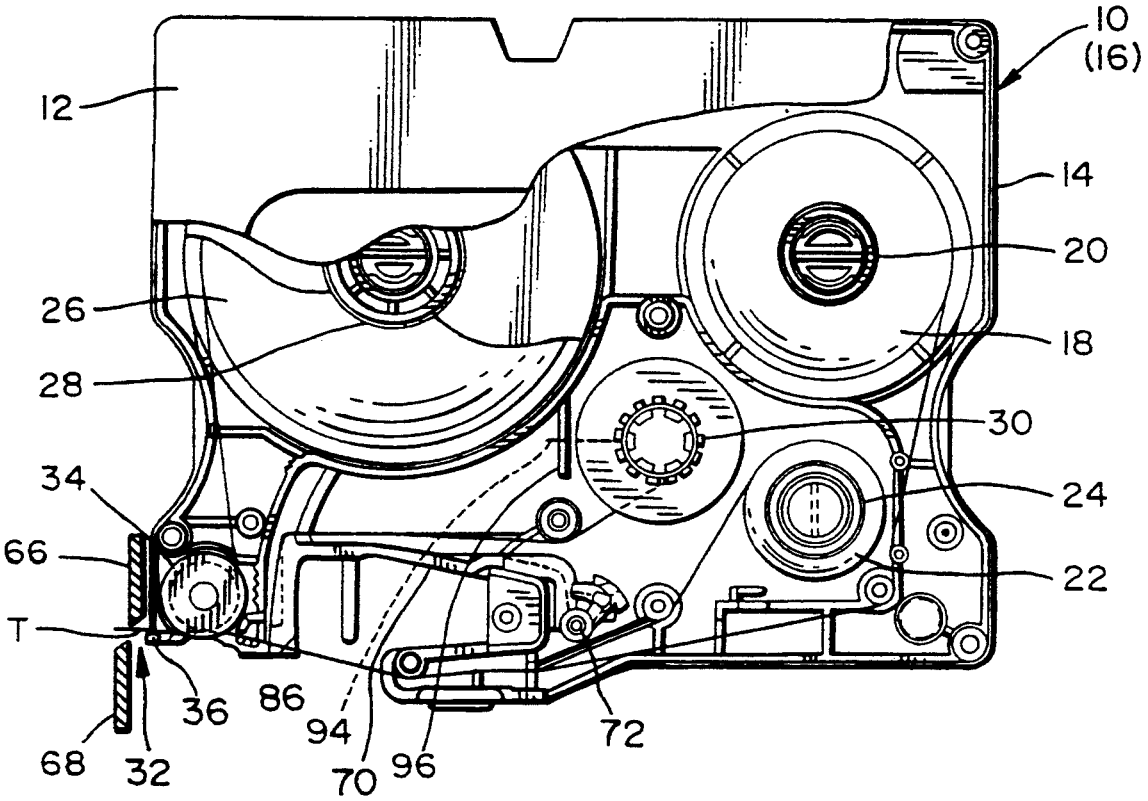
FIGS. 1A and 1B are plan views of a tape cassette embodying the present invention from which almost all the portion of an upper cover member is removed.
Figure 1B:
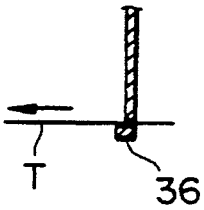

FIG. 1 shows the arrangement of a tape cassette 10 embodying the present invention.

The tape cassette 10 has a cassette case 16 composed of an upper cover member 12 and a lower case member 14 (in FIG. 1, almost all the portion of the upper cover member 12 is removed). Then, suitably and rotatably disposed in the cassette case 16 are:

a tape spool 20 around which a film tape 18 is wound;

a ribbon spool 24 around which an ink ribbon 22 is wound;

an adheslve tape spool 28 around which a double-sided adhesive tape with a release paper 26 being provided thereon such that the release paper side thereof faces to the outside; and a ribbon winding spool 30 for winding the ink ribbon 22 fed from the ribbon spool 24.

Further, a tape drive roller 34 Is also rotatably disposed in the vicinity of a tape exit slit 32 opened at one side of the cassette case 16. The tape drive roller 34 feeds out a tape T, which Is composed of the above film tape 18 adhered to the double-sided adhesive tape 26. from the tape exit slit 32 in association with a tape feed roller 62 provided with a printing device to be described later.

Figure 2:
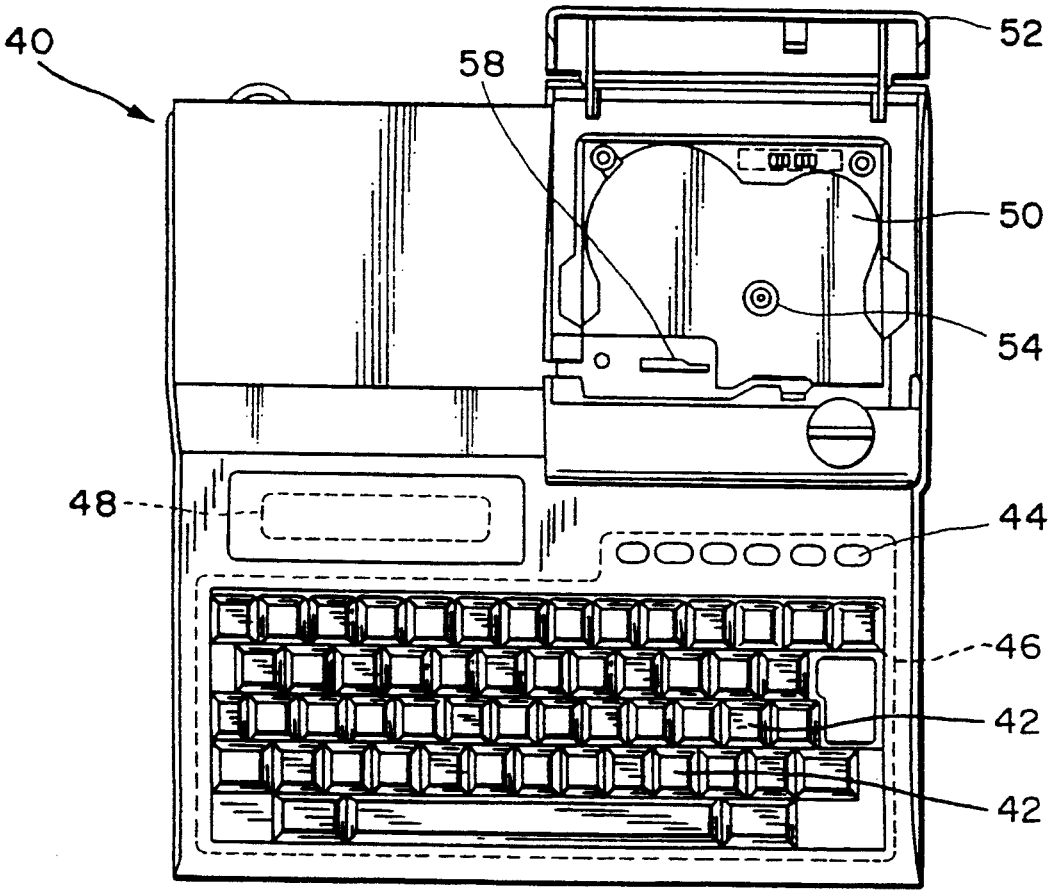
FIG. 2 is a plan view of a printing device to which the tape cassette is to be attached.

The printing device which the tape cassette is to be coupled to is shown in FIG. 2.

As shown in FIG. 2, In the printing device 40, provided are:

a character input key 42 for Inputting characters and the like;

print key 44;

key board 46 on which various kinds of function key are provided;

liquid crystal display 46 for displaying characters and the like Input through the key board 46; and a cassette accommodation unit 50 to which the tape cassette 10 is to be attached. An accommodation cover 52 is rotatably supported for covering an accommodation chamber of the tape cassette 10 at the rear portion of the printing device 40. The tape cassette 10 is attached/detached when the accommodation cover 52 is opened.

Figure 3:
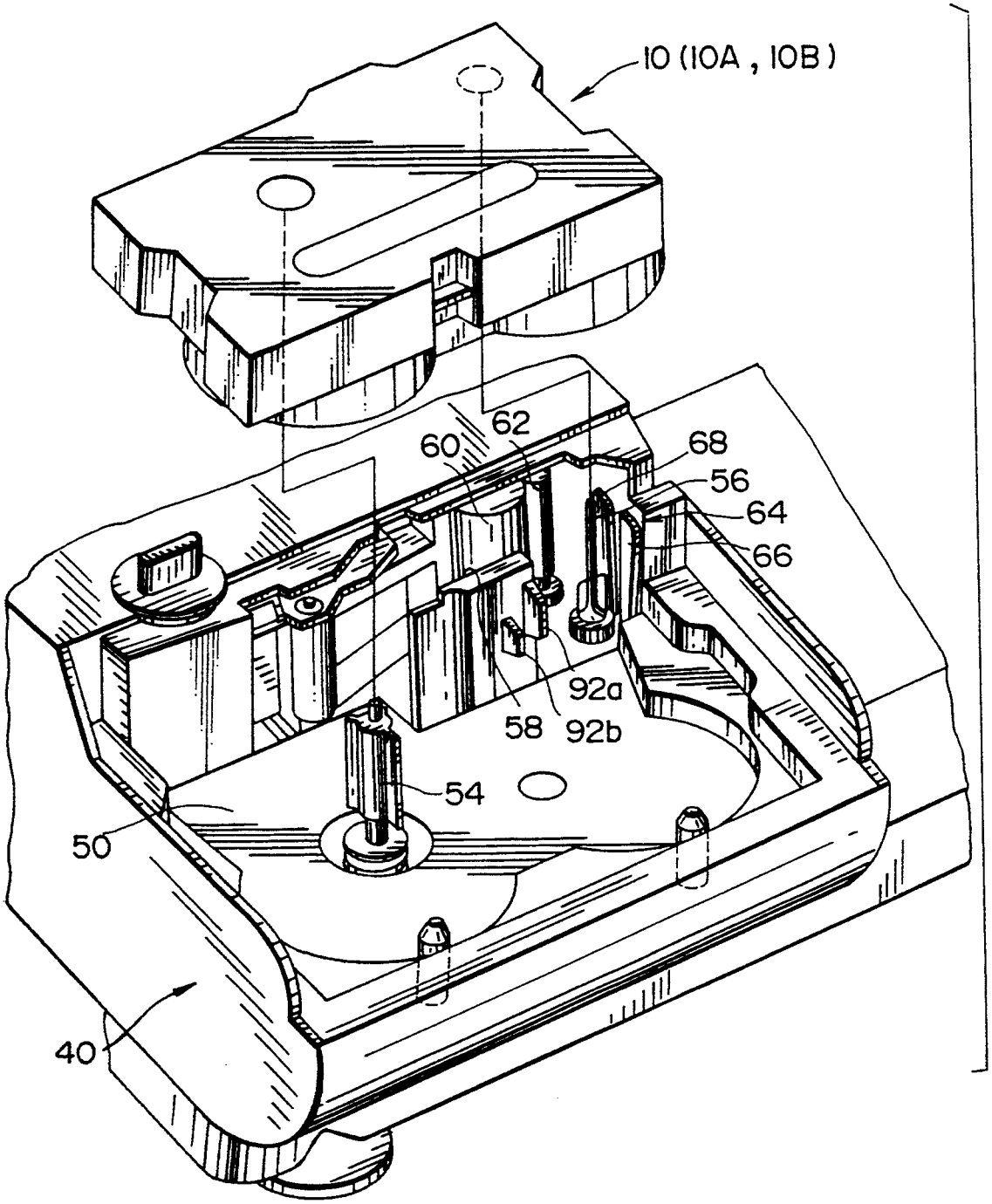
FIG. 3 is perspective view of the cassette accommodation unit of the printing device shown in FIG. 2.
Figure 4:
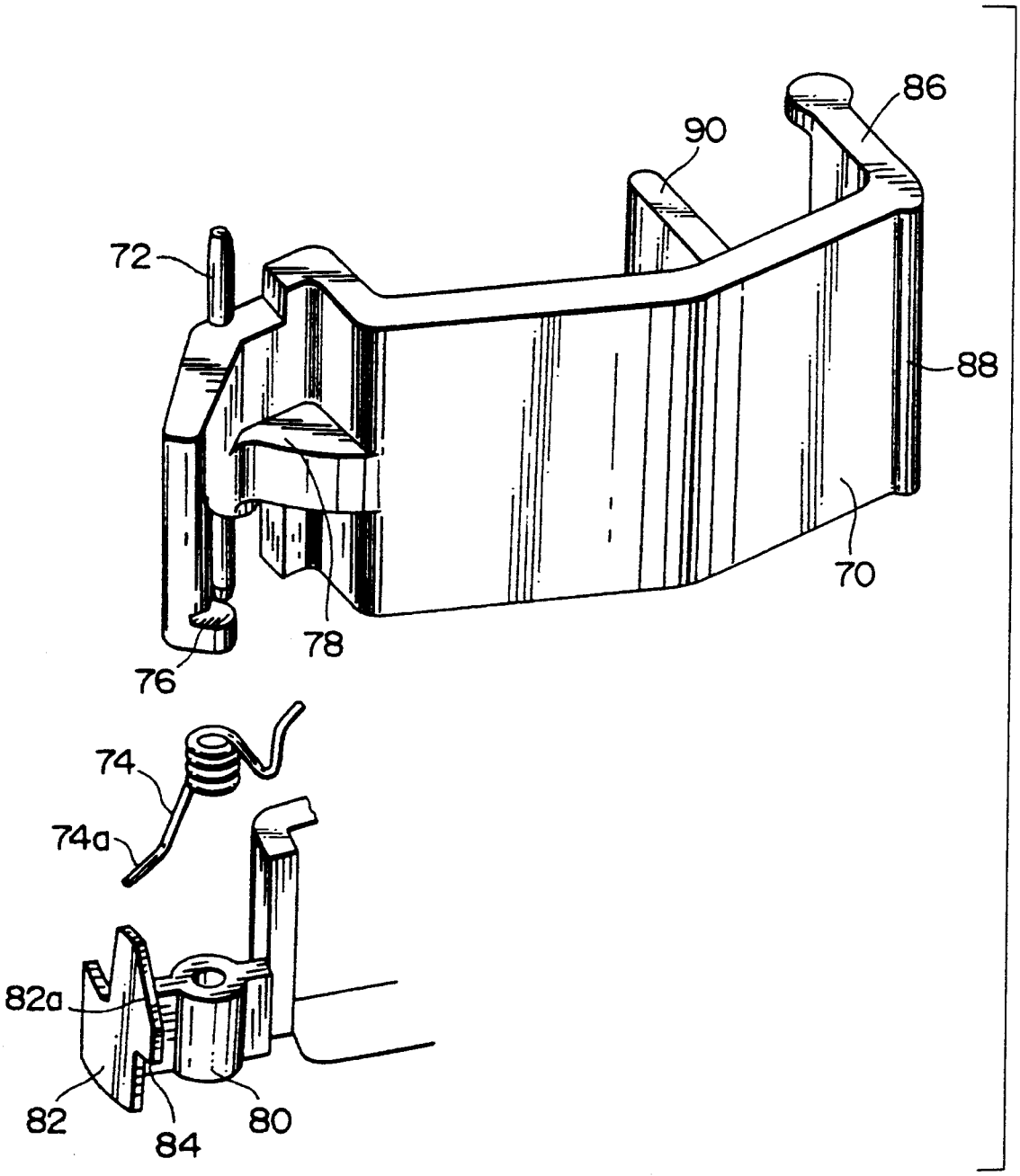
FIG. 4 is an exploded perspective view of a tension lever in the tape cassette shown in FIG. 1.

FIG. 3 schematically shows the cassette accommodation unit 50.

In the cassette accommodation unit 50, a ribbon winding shaft 54 is standingly disposed. The ribbon winding shaft 54 is driven by a pulse motor to rotate, and is engaged with the ribbon winding spool 30 of the tape cassette 10 to rotate the ribbon winding spool 30 In order to wind the ink ribbon 22. Further, a tape drive shaft 56 is also standingly disposed which is engaged with the tape drive roller 34, and rotates the same. The tape drive shaft 56 is engaged with a not shown motor through a not shown gear transmission mechanism.

A thermal print head 58 and platen roller 60 are standingly disposed in confrontation, and further the above tape feed roller 62 is disposed to feed the adhered tape T in association with the above tape drive roller 34. Although not described in detail, the platen roller 60 and feed roller 62 are supported by a roller holder and switched to a print position and release position by a not shown switch mechanism. This switch mechanism is described in detail in Japanese Patent Provisional Publication HEI 3-283814, and accordingly the description thereof is omitted here.

The above thermal print head 58 includes a plurality of heating elements for printing image such as characters and the like to the film tape 18 with use of the ink ribbon 22.

A tape cutter 64 is also disposed at a position adjacent to one side of the cassette accommodation unit 50 to cut the adhered tape T discharged from the tape exit slit 32 of the tape cassette 10.

The tape cutter 64 is composed of a fixed blade 66 and movable blade 68. The fixed blade 66 is fixedly arranged at a position adjacent to the tape exit slit 32, and the movable blade 68 Is movably positioned at a position away from the tape exit slit 32.

Figure 5:
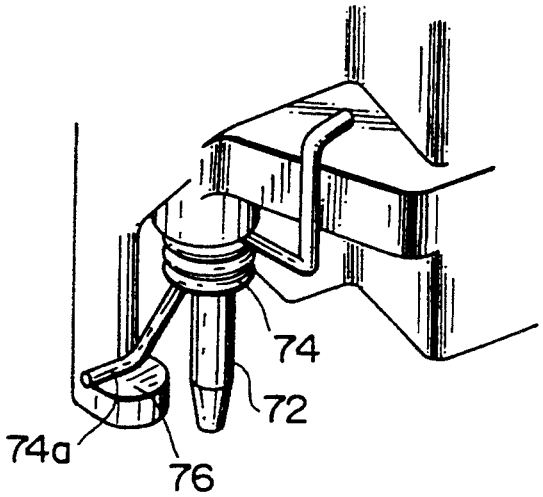
FIG. 5 is a diagram explaining the state that a torsion spring is mounted to the support shaft of the tension lever shown in FIG. 4.

Although not described in detail, the mechanism for driving the tape cutter 64 transmits the drive force of a motor to the movable blade 68 through a gear mechanism to move the movable blade 86 about it's fulcrum. Thus, the adhered tape T is cut off by the closing operation of the movable blade 68 in association with the fixed blade A tension lever 70 for stretching the above ink ribbon 22 Is rotatably disposed about a shaft 72 as shown In FIG. 1. As shown In FIGS. 4 to 7 in detail, the shaft 72 is inserted into a shaft receiving cylinder 80 disposed on the inner bottom surface of the lower case member 14 in such a fashion that the opposite ends of a torsion spring 74, into which the support shaft 72 is to be fitted, are locked to stepped portions 76, 78 extending to the tension lever 70 as shown In FIG. 5.

Figure 6:
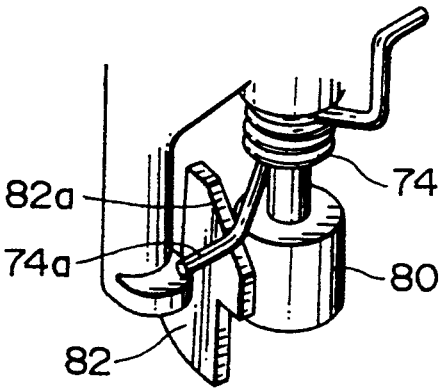
FIG. 6 is a diagram explaining the process for inserting the tension lever shown in FIG. 5 into the shaft receiving cylinder on a lower case member.
Figure 7:
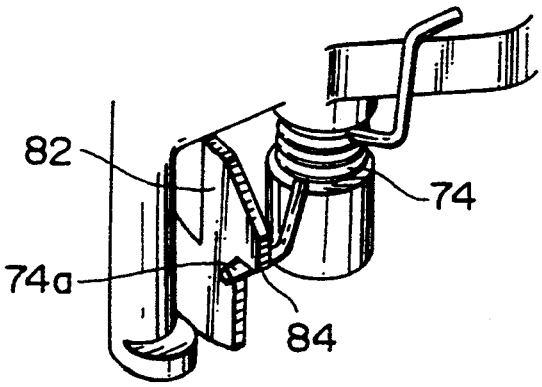
FIG. 7 is diagram explaining the state that the tension lever shown in FIG. 5 has been inserted into the shaft receiving cylinder on the lower case member.

As shown In FIG. 6, one end of the spring 74*a* of the above torsion spring 74 slides down along the tapered surface 82*a* of a tapered piece 82 which is standingly disposed on the Inner bottom surface of the lower case member 14 (See FIG. 6), and locked by the hook portion 84 formed below the tapered end (See FIG. 7). With this arrangement, the tension lever 70 is urged by the torsion spring 74 to rotate counterclockwise in FIG. 1 about the support shaft 72.

As described above, the support shaft 72 of the tension lever 70 Is mounted to the shaft receiving cylinder 80 in the state that the torsion spring 74 is unremovably mounted to the support shaft 72. Thus, while the support shaft 72 of the tension lever 70 is mounted thereto, the torsion spring 74 Is prevented from being suddenly removed from the support shaft 72 and thus a mounting Job is improved.

Further, a bent piece 86 is extended from the extreme end of the above tension lever 70 and abutted against the ink ribbon 22. Furthermore, the ink ribbon 22 is released from the tension lever 70 by an externally projecting edge 88 formed at the base portion of the bent portion 86 and wound up by the ribbon winding spool.

Figure 8:
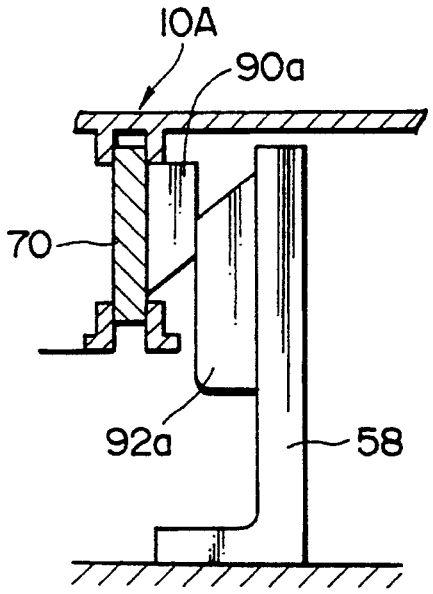
FIG. 8 is a cross sectional view explaining the state that the contact piece of the tension lever in a narrow tape cassette is engaged with the inclined piece of a thermal print head.
Figure 10:
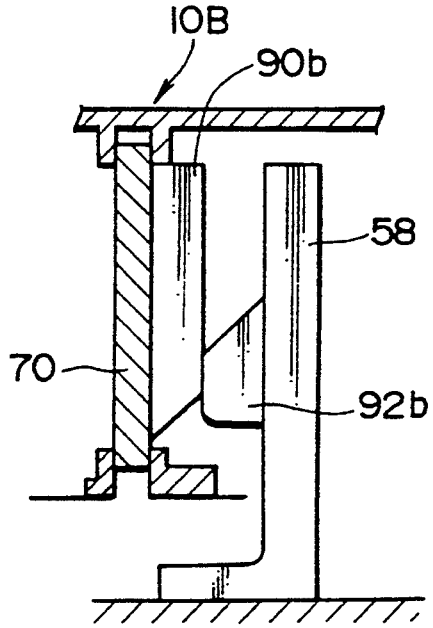
FIG. 10 is a cross sectional view explaining the state that the contact piece of the tension lever in a wide tape cassette is engaged with the inclined piece of a thermal print head.

A contact piece 90 is projected from a midway portion of the tension lever 70 so that It confronts the backside of the thermal print head 58 when the tape cassette 10 is attached to the cassette accommodation unit 50. As shown In FIG. 3, a pair of inclined pieces 92*a* and 92*b* having a different height are disposed In parallel on the backside of the thermal print head 40. In this embodiment, in case of a narrow tape cassette 10A, the contact piece 90 is confrontingly disposed to be engaged with the higher inclined piece 92*a*, as shown in FIGS. 8 and 9; and in case of a wide tape cassette 10B, it is confronting if disposed to be engaged with the lower inclined piece 92*a*, as shown in FIGS. 10 and 11.

Figure 9A:
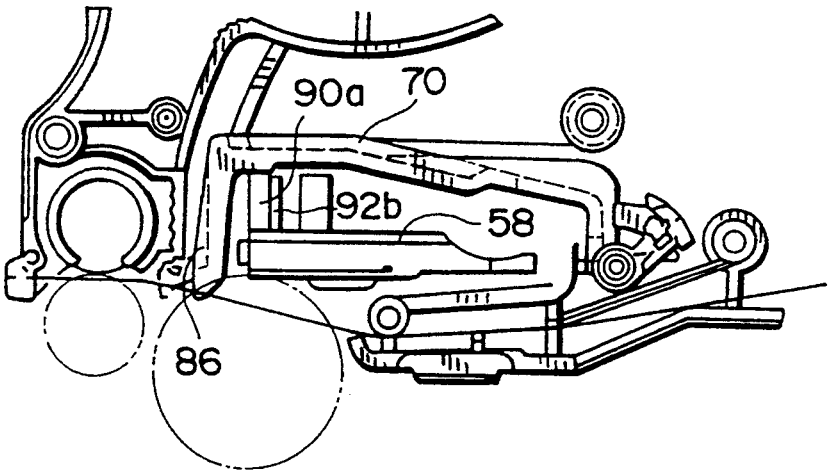
FIGS. 9A and 9B are diagrams explaining the rotating state of the tension lever when the narrow tape cassette is mounted to the printing device.
Figure 9B:
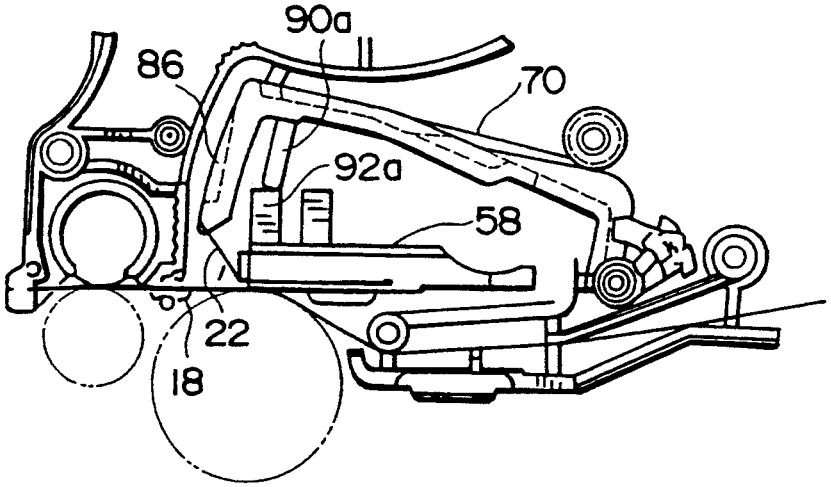
Figure 11B:
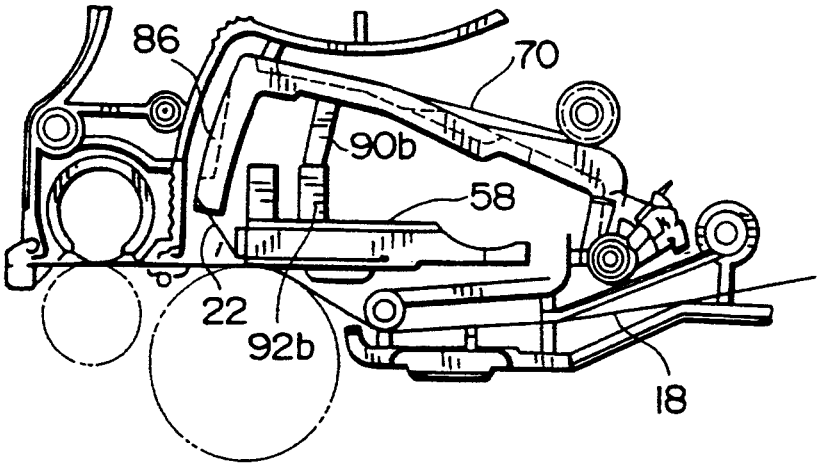

With this arrangement, as the narrow tape cassette 10A is attached to the cassette accommodation unit 50. the contact piece 90*a* is engaged with the higher inclined piece 92*a* on the backside of the thermal print head 58 at its earlier stage, as shown in FIGS. 9(*a*). (*b*). Therefore,. the tension lever 70 begins to be rotated relatively earlier. As the wide tape cassette 10B is attached,. since the contact piece 90*b* of the tension lever 70 begins to be engaged with the lower inclined piece 92*b* later than in the case of the narrow tape cassette 10A. as shown in FIGS. 11A, 11B. the tension lever 70 begins to be rotated relatively later in timing.

This release timing is earlier when the narrow tape cassette 10A is used with respect to the timing when the wide tape cassette 10B is used. If it is earlier when the wide tape cassette 10B is used, there is a possibility that the ink ribbon 22 is hitched to the edge of the thermal print head 58,. and therefore the release timing when wide tape cassette 10B is used is delayed with respect to the case when the narrow tape cassette 10A is used.

Further, the contact pieces 90*a* and 90*b* have upwardly inclined surfaces at the lower edge thereof, respectively, and the inclined pieces 92*a* and 92*b* have downwardly if inclined surfaces at the upper edge thereof, respectively, in correspondence with the upwardly inclined surfaces.

When the cassette tape is attached to the cassette accommodation unit 50 from thereabove, the above-described arrangement causes the respective contact pieces 90*a*, 90*b* to be easily slid along the inclined surfaces of the inclined pieces 92*a*, 92*b*, thus the tension lever 70 can be smoothly rotated.

As the tension lever 70 is moved, the length of a path from the ribbon spool 24 to the ribbon winding spool 30 becomes equal to or longer than that before the tension lever 70 is rotated.

Therefore, even if the ink ribbon is loosely wound before the tape cassette is used, when the tape cassette is actually attached to the printing device, the loosened state of the ink ribbon is removed.

Further, since the ink ribbon 22 is released from the tension lever 70 at an externally projecting edge 88, the ink ribbon 22 is prevented from being electrostatically and unremovably attached to the backside of the tension lever 70, and thus the ink ribbon 22 can be smoothly fed.

Further, the projecting amount of the contact piece 90 depends upon the kind of an ink used in the ink ribbon 22.

The reason is as follows.

The composition of an ink used for the ink ribbon 22 is categorized into a wax type and resin type. If the Ink is of the resin type, it is cooled and solidified in a relatively short period after it has been printed, and thus the ink ribbon must be exfoliated by a large amount. For this purpose, when the ink is the resin type, the contact piece 90 has a large projection width so that the film tape is exfoliated from the ink ribbon at a large exfoliating angle.

On the other hand, if the ink is of the wax type, a time necessary for the ink to be cooled and solidified Is not so short, and thus the exfoliating angle should be small to provide a time necessary for the ink ribbon 22 to be fixedly adhered to the film tape.

The arrangement of the ribbon winding spool 30 will be described with referring to FIG. 1. In the figure, a clutch coil spring 94 is attached to the base portion of the ribbon winding spool 30. Although an end of the clutch coil spring 94 is pressed against the ribbon winding spool 30, the other end thereof is locked by the locking piece 96 on the lower case member 14.

Consequently, when a tension larger than a predetermined value is applied to the ribbon winding spool 30 when printing, the ribbon winding spool 30 is idly rotated by the action of the above clutch coil spring 94, and thus a winding torque is adjusted.

Further, as shown in FIGS. 12A through 12C, and 13, the upper cover member 12 is unremovably engaged with the lower case member 14 by the following arrangement in both cases of the narrow tape cassette 10A and wide tape case 10B. That is, a bridge portion 100 is formed at the extreme end of a cylindrical shaft 98*a* or 98*b* on which the adheslve tape spool 28 Is fitted; and a pair of elastic snapping pieces 102*a*, 102*b* are projected on the inner surface of the upper cover member 12 so as to snap the bridge portion 100 from the opposite sides thereof. As a result, when the upper cover member 12 is placed on the lower case member 14, the above snapping pieces 102*a*, 102*b* elastically snap the bridge portion 100 of the above cylindrical shaft 98*a* or 98*b* from the opposite sides thereof.

Thus the displacement of the double-sided adhesive tape 26 wound around the adhesive tape spool 28 in the axial direction of the spool 28 is prevented by the lower surface of the upper cover member 12, as shown in the figure. Therefore, a winding displacement which could be caused by the viscosity of the ink due to the heat of a print head, humidity in the environment where the device is used, and the like can be prevented.

Further, according to the present invention, a bill-shaped tape receiving portion $6 is provided at the tape exit slit 32 of the tape cassette 10 and extends to the vicinity of the extreme end of the fixed blade 66. Then, the extreme end of the adhered tape T fed through the tape exit slit 32 of the tape cassette 10 is guided to the extreme ends of both fixed blade 66 and movable scissor blade 68 of the tape cutter 64 in such a fashion that the extreme end of the tape T is just received by and stopped at the bill-shaped tape receiving portion 36.

According to the tape cassette 10 arranged as above, when the tape cassette 10 is to be attached to the cassette accommodation unit 50 of the printing device 40, first, the contact piece 90 of the tension lever 70 of the tape cassette 10 is abutted against the inclined piece 92 of the thermal print head 58. Then, when the tape cassette 10 is further inserted into the cassette accommodation unit 50, the above contact piece 90 slides along the above inclined piece 92 to cause the tension lever 70 to be rotated to a predetermined position about the support shaft 72 as a fulcrum. Thus, the tape cassette 10 is attached.

Next, there will be described an operation for printing characters and the like to a surface of the film tape 18 accommodated in the tape cassette 10 and providing the adhered tape T by adhering the double-sided adhesive tape 26 to the film tape 18.

Characters and the like are thermally printed to the surface of the film tape 18 through the ink ribbon 22 based on print information supplied to the thermal print head 58 while the above film tape 18 overlapped with the ink ribbon 22 passes between the thermal print head and the platen roller.

Then, the film tape 18 is adhered by the association of the tape drive roller 34 and tape feed roller 62, and fed out of the tape exit slit 32 as the adhered tape T. After the completion of the tape printing, the adhered tape T is cut off by the movable blade 68 and fixed blade 66 of the tape cutter 64.

At this time, according to the present invention, the tape exit slit 32 has the tape receiving portion 36 just extended to the vicinity of the extreme end of the fixed blade. Therefore, an amount of the tape T projecting from the tape exit slit 32 after having been cut off is less than the thickness of the lower case member which is increased by the tape receiving portion 36 in the state that the extreme end of the adhered tape T on the tape cassette 10 side is held on the surface of the tape receiving portion 36.

Consequently, even if the extreme end of the adhered tape T having been cut off is carelessly pulled or pushed Into the cassette case, the tape T can surely be pulled out.

As apparent from the foregoings, according to the present invention, the extreme end of a film tape remaining In the cassette case after having been printed and fed out of the tape exit is received by and stopped at a bill-shaped tape receiving portion which is extending from the tape exit of the tape cassette. Therefore, there is an advantage that the tape cassette can be used without anxiety because such a situation that the tape T is pulled into the tape cassette main body and cannot be taken out can be prevented.

Further, the upper cover member is securely engaged to the lower case member as the engagement portion and the locking piece, which are provided on one and the other of the extreme end of the shaft disposed to the lower case member and the upper cover member. Thus, the tape cassette is not deformed by the expansion of the release paper due to the Influence of a temperature humidity and the like.

What is claimed is:

1. A tape cassette accommodating a tape-shaped member, said tape cassette comprising an accommodation case member with a side and a cover member for covering said accommodation case member, a single exit slit, said exit slit being formed on said side;

wherein said tape-shaped member is ejected through said exit slit, and wherein said accommodation case member has at least one protruded portion at said exit slit, said protruded portion being provided to prevent an end of said tape shaped-member from being retracted into the cassette, said protruded portion being protruded by a predetermined amount in the feeding direction of said tape-shaped member and extending along said exit slit.

2. The tape cassette according to claim 1, wherein said protruded portion is formed to protrude on the outer side of said accommodation case member.

3. The tape cassette according to claim 1, wherein said tape cassette accommodating a plurality of tape-shaped members, said plurality of tape-shaped members being drawn out of said tape cassette through said exit slit.

4. The tape cassette according to claim 1 wherein said protruded portion extends outwardly of said accommodation case.

5. The tape cassette according to claim 1 wherein said tape-shaped member include two shapes, and further comprising means for adhering said two tapes on the upstream side of said exit slits.

6. A combination of a printing device and a tape cassette accommodating a tape-shaped member to be used for printing by said printing device, wherein said tape cassette comprises an accommodation case member and a cover member for covering said accommodation case ember, a single exit slit, said exit slit being formed on said accommodation case member, said tape-shaped member being ejected through said exit slit, wherein said accommodation case member has at least one protruded portion at said exit slit, said protruded portion being provided to prevent an end of said tape from being retracted into said cassette, said protruded portion being protruded by a predetermined amount in the feeding direction of said tape-shaped member and extending along said exit slit, and wherein said printing device comprises cutter means for cutting said tape-shaped member in the vicinity of said exit slit.

7. The combination according to claim 6, wherein said tape-shaped member is a recording tape on which images are to be printed thereon by said printing device.

8. The combination according to claim 7, wherein said tape cassette further accommodating an ink ribbon, wherein said printing device prints images on said recording tape with use of said ink ribbon.

9. The combination according to claim 8, wherein said tape cassette further accommodating an adhesive tape, said adhesive tape being adhered to said recording tape after images have been printed.

10. The combination according to claim 9, wherein said recording tape is fed out of said tape cassette through said exit slit after said adhesive tape is adhered on said recording tape.

11. The combination according to claim 9, wherein said recording tape comprises a transparent tape.

12. The combination according to claim 9, wherein said adhesive tape comprises a double-sided adhesive tape.

13. The tape cassette according to claim 6 wherein said tape-shaped member includes two tapes, and further comprising means for adhering said two tapes on the upstream side of said exit slit.

14. A tape cassette, comprising an accommodation case member for accommodating a tape-shaped member, and a cover member for covering said accommodation case member, said accommodation case member comprising a shaft member on which a spool is fitted, said tape-shaped member being wound about said spool, said tape cassette further comprising:

snapping means provided on one of an extreme end of said shaft member and said cover member; and receiving means provided on the other one of said cover member and said extreme end of said shaft member for receiving said at least one snapping means so as to fix said cover member onto said accommodation case member, said receiving means including means to prevent said one snapping member from being disengaged.

15. The tape cassette according to claim 14 wherein said snapping means includes a pair of elastic snapping pieces on said cover member and said receiving means includes a bridge on said shaft and fitted between said snapping pieces.

16. A tape cassette accommodating a tape-shaped member which is wound around a spool, said tape cassette comprising an accommodation case member provided with a shaft, said spool being rotatably fitted on said shaft, and a cover member for covering said accommodation case member, said tape cassette further comprising:

engaging means provided on one of the extreme end of said shaft and said cover member; and receiving means provided on the other of said extreme end of said shaft and said cover member for receiving said engaging means to fix said cover member onto said accommodation case member.

17. The tape cassette according to claim 16, which is capable of accommodating a plurality of tape-shaped members respectively wound around spools, wherein said accommodation case member is provided with a plurality of shafts, said spools being fitted onto said plurality of shafts, respectively, wherein said engaging means comprises a plurality of engaging members each of which provided on one of said cover member and said extreme end of said plurality of shafts, and wherein said receiving means comprises a plurality of receiving members for receiving said plurality of engaging members, each of said receiving members being provided the other of said extreme end of said plurality of shafts and said cover member in correspondence with said engaging members.

18. A tape cassette accommodating a tape-shaped member which is wound around a spool, said tape cassette comprising an accommodation case member provided with a shaft, said spool being rotatably fitted on said shaft, and a cover member for covering said accommodation case member, an exit slit being formed on said accommodation case member, said tape-shaped member being fed out of said tape cassette through said exit silt, wherein said accommodation case member has at least one protruded portion at said exit slit, said protruded portion being protruded by a predetermined amount in the feeding direction of said tape-shaped member and extending along said exit slit, and wherein said tape cassette further comprising:

engaging means provided on one of the extreme end of said shaft and said cover member; and receiving means provided on the other of said extreme end and said cover member for receiving said engaging means to fix. said cover member onto said accommodation case member.

19. The tape cassette according to claim 18, wherein said engaging means comprises a pair of snapping members provided on one of said cover member and said accommodation case member, and wherein said receiving means comprises a receiving member provided on the other one of said cover member and said accommodation member.

* * * * *